US005238416A

United States Patent [19]

Dickie

[11] Patent Number: 5,238,416

[45] Date of Patent: Aug. 24, 1993

[54] EXTENSION CORD RECEPTACLE

[75] Inventor: Robert G. Dickie, Newmarket, Canada

[73] Assignee: Paige Manufacturing Corp., Newport Beach, Calif.

[21] Appl. No.: 892,396

[22] Filed: May 28, 1992

Related U.S. Application Data

[63] Continuation of Ser. No. 740,223, Aug. 5, 1991, abandoned.

[51] Int. Cl.[5] ..... H01R 13/44

[52] U.S. Cl. ..... 439/148; 439/142; 439/476; 439/654

[58] Field of Search ..... 439/135, 136, 142, 148, 439/476, 596, 650, 651, 654

[56] References Cited

U.S. PATENT DOCUMENTS

| | | | |
|---|---|---|---|
| Re. 31,033 | 9/1982 | Wilson, Jr. et al. | 439/654 |
| 3,389,367 | 6/1968 | Schwartz | 439/148 |
| 3,876,273 | 4/1975 | Schwartz | 439/148 |
| 4,006,958 | 2/1977 | Kramer et al. | 439/483 |
| 4,408,813 | 10/1983 | Koehler | 439/148 |
| 4,729,741 | 3/1988 | Peng | 439/135 |

*Primary Examiner*—Paula A. Bradley

[57] ABSTRACT

An electric extension cord receptacle includes side recesses to aid in grasping the receptacle while removing electric plugs from the receptacle. Two safety flaps attached to the receptacle body by living hinges pivot to cover unused electric sockets in the receptacle. The hinges are undercut to create preferred fold lines to properly register plastic plugs on the safety flaps with receiving slots in the electric sockets.

13 Claims, 2 Drawing Sheets

EXTENSION CORD RECEPTACLE

CROSS REFERENCE TO RELATED APPLICATION

This application is a continuation of application Ser. No. 740,223, filed Aug. 5, 1991, now abandoned.

TECHNICAL FIELD

This invention relates to electrical extension cords and, more particularly, to ultra safe electrical extension cords for connecting electrical appliances to electrical wall outlets.

BACKGROUND OF THE INVENTION

It has been common to fashion the sides of the outer surface of electrical extension cord receptacles with flat, vertical surfaces in order to minimize the fabrication cost of such receptacles. Such a shape not only minimizes the amount of plastic used in the molding process, but also avoids the necessity of "side cores" which must be withdrawn from the mold sideways before the molded part can be ejected from the mold. The added tooling necessary for such side cores would add significantly to the cost of the mold. The difficulty with such flat sides to the extension cord receptacle is the high degree of difficulty in removing an electrical plug from the extension cord receptacle. Since the fingers have little or no "purchase" on the sides of the receptacle, a great deal of finger strength is required to hold the receptacle while a plug is being removed. Moreover, when removing an electric plug from a prior art receptacle, there is a tendency to increase purchase on the receptacle body by inserting one's fingers into the widening gap under the plug as the plug is withdrawn. Since the electrical contacts in the plug are "live" until the plug is fully withdrawn, contact with such exposed contacts can result in dangerous shocks. The danger of such shocks is increased by the tendency to rock one's fingers into the opening while working the contact power blades loose from the receptacle contacts.

It has also become a requirement for all multi-outlet, non-grounded extension cord outlets to provide a cover to block all of the unused outlets on the receptacle. The prior art has typically provided an integrally molded long strip of plastic at the end of the receptacle which can be folded back and locked into position over either one or two outlets on the same side of the receptacle. Plastic plugs on the plastic strip must be aligned with one or the other set of electrical receptacle openings to lock the strip into position. Such long flaps require alignment of the plastic plugs with the receptacle openings to permit their use and hence are sometimes ignored when alignment is difficult. Furthermore, the double flap can only be used to cover electrical receptacle outlets on one side of the extension cord receptacle, leaving outlets on the other side uncovered if plugs are inserted only into the outlets on the one side.

SUMMARY OF THE INVENTION

In accordance with the illustrative embodiment of the present invention, electrical extension cord receptacles are fabricated with relatively deep depressions in each side thereof to provide adequate purchase for fingers to safely remove the plugs from the receptacle without placing the fingers in a position likely to allow contact with the live power blades of the plug as the plug is being removed. More particularly, the sides of the electrical extension cord receptacle perpendicular to the faces of the receptacle having plug receptacle openings therein are shaped with finger-admitting depressions or indents with a substantial surface which is not parallel to such sides and therefore provides a significant purchase for holding the receptacle while electrical plugs are being removed therefrom. It has been found that a depression which is at least fifteen percent of the width of the receptacle provides adequate purchase to permit easy removal of electric plugs from the receptacle.

In accordance with one feature of the present invention, the electric extension cord receptacle is fabricated with two hinged non-conductive flaps having non-conductive blades thereon for insertion into the electric openings of the receptacle when those openings are not in use. More particularly, a cover flap is molded so as to be attached to each plug-receiving surface of the receptacle and dimensioned so as to cover a single adjacent set of receptacle openings. Each cover flap is undercut along a preferred fold line so that the non-conductive blades are automatically aligned with the mating receptacle openings and hence requires no manual registration as in the prior art. Moreover, openings on both sides of the extension cord receptacle can be covered, rather than openings on one side only as in the prior art, by providing two separate cover flaps rather than a single cover flap.

BRIEF DESCRIPTION OF THE DRAWINGS

A complete understanding of the present invention may be gained by considering the following detailed description in conjunction with the accompanying drawings, in which.

To facilitate reader understanding, identical reference numerals are used to designate elements common to the figures.

DETAILED DESCRIPTION

Figure 1:
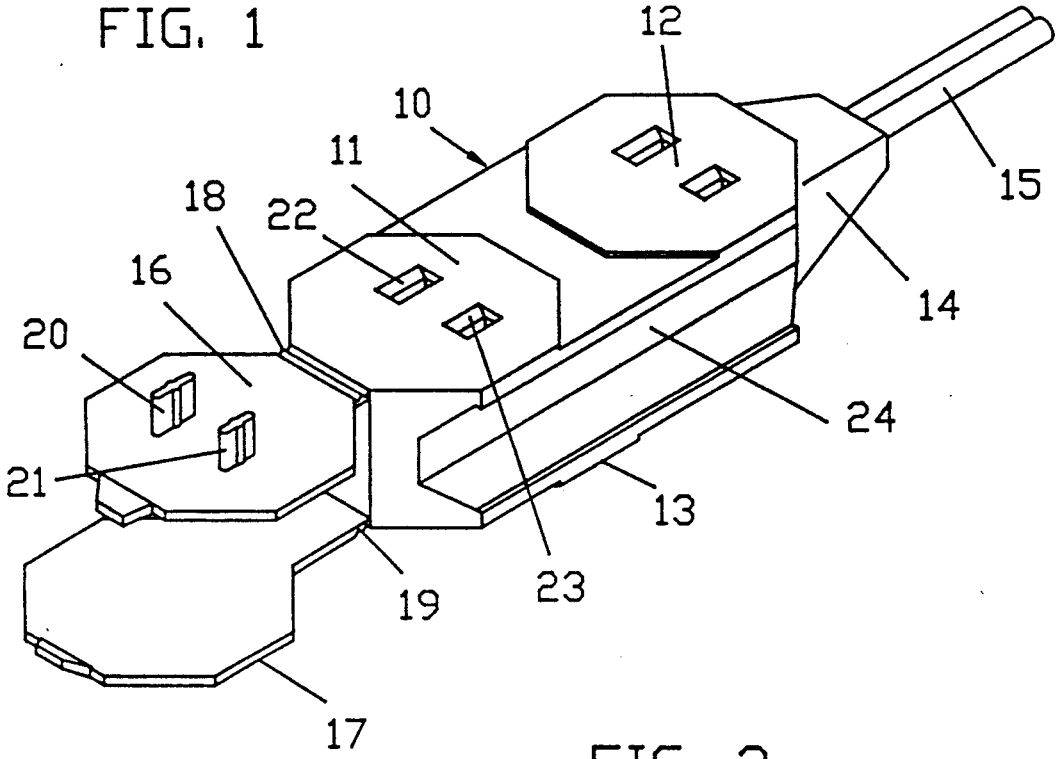
FIG. 1 shows a perspective view of an electric extension cord receptacle in accordance with the present invention showing the finger recesses in both sides of the receptacle and the cover flaps at both receptacle opening surfaces of the receptacle.

In FIG. 1 there is shown a perspective view of an electric extension cord receptacle in accordance with the present invention comprising a generally rectangular, box-shaped receptacle body 10 having electric plug-in sockets 11, 12 and 13 therein on opposites faces of body 10. A conically shaped strain relief sleeve 14 at one end of body 10 connects an electric cord 15 to body 10. Two safety cover flaps 16 and 17 are connected to the other end of body 10 by narrow hinge areas 18 and 19, respectively. Each of cover flaps 16 and 17 have molded on the outer surfaces thereof a pair of plastic plugs such as plugs 20 and 21 which fit into the recessed slots such as slots 22 and 23 of socket 11. Each of plugs 20 and 21 has an irregular cross section to assist in holding the plugs in the slots of the sockets 11, 12 and 13. When cover flap 16 is folded on hinge 18, the plugs 20 and 21 automatically align with slots 22 and 23 to permit the insertion of plugs 20 and 21 into slots 22 and 23 and thereby provide a safety cover for socket 11. Similar plugs on the hidden side of cover flap 17 fit into similar slots on the socket 13 on the underside of body 10 to provide a similar safety cover for socket 13. Cover flaps 16 and 17 permit all unused sockets of extension cord receptacle of FIG. 1 to be covered to prevent the inadvertent insertion of objects into the socket slots and thus protect infants, small children or inattentive users from electrical shock. Receptacle body 10 is preferably fabricated by injection molding techniques from non-conducting plastic material such as polyvinylchloride (PVC).

Each of two opposing sides of body 10 perpendicular to the faces of sockets 11, 12 and 13 have recesses 24 and 25 (see FIG. 3) of sufficient depth and size to allow the users fingers to secure a sufficiently firm purchase on the body 10 to permit the removal of electric plugs from sockets 11, 12 and 13. Prior art electric extension cord receptacles have had generally flat side surfaces (perpendicular to the socket faces) which have often made the removal of electric plugs from the receptacle extremely difficult. If the user experiences difficulty in removing the plug, there is a tendency for the user to place fingers on the socket face of the plug body to increase purchase on the receptacle. The positioning of fingers on the socket surface exposes the user to shocks from the emerging plug blades which remain alive electrically until the blades are almost entirely withdrawn from the socket slots. Even more dangerously, there is a tendency of the user to rock the plug back and forth to facilitate easy removal. Such a rocking action, however, increases the danger of exposing fingers to the electrified blades of the emerging connector blades. It has been found that depressions having a depth of at least fifteen percent of the width of the receptacle (about a quarter of an inch) are adequate to provide sufficient purchase to remove electrical plugs from the receptacle.

Figure 2:
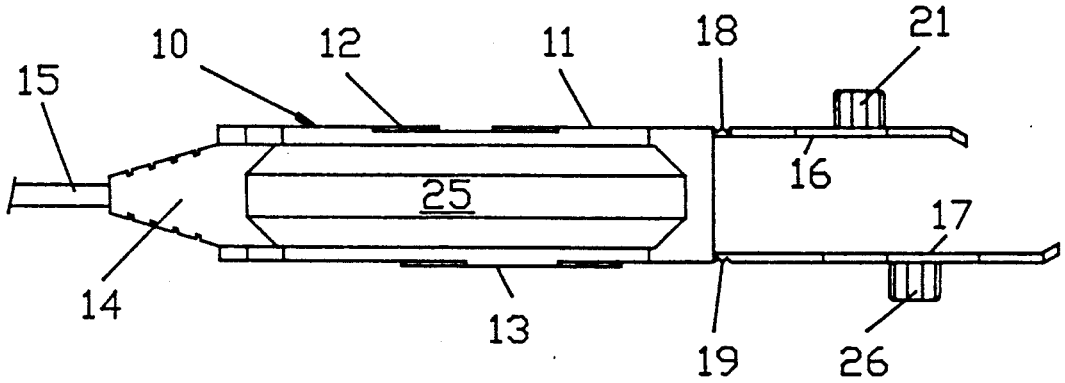
FIG. 2 shows a side elevation view of the electric extension cord receptacle shown in FIG. 1.

In FIG. 2 there is shown a side elevation view of the extension cord receptacle shown in FIG. 1. showing the receptacle body 10 having sockets 11, 12 and 13 on upper and lower surfaces thereof. A strain relief sleeve 14 connects an electric cord 15 to the receptacle body 10. Recess 25 in body 10 provides a better purchase for holding receptacle body 10 when removing electric plugs from socket 11, 12 or 13. Safety cover flaps 16 and 17, including plastic plugs 21 and 26 are attached to the end of body 10 by hinge areas 18 and 19, respectively. Note that the hinge areas 18 and 19 are undercut to restrict the thickness of the hinge area and thus forming a more easily folded "living hinge" at the desired fold line along the cover flaps 16 and 17. This fold line precisely registers the plastic plugs 21 and 26 with the mating slots in sockets 11 and 13, respectively. This automatic precise registration of safety plugs with socket slots makes the insertion of the safety plugs into the socket slots easily accomplished, even without being able to see the receptacle. Prior art safety flaps, on the other hand, are located only on the double outlet side of the extension cord receptacle, and are designed to fit alternatively into either socket on the two-socket side of the receptacle. This requires the user to carefully locate the plugs in registration with the socket slots before locking the safety cover into place. The difficulty in making such a user-controlled registration, particularly when the user cannot see the receptacle, often results in the failure to use the safety cover, thus defeating the purpose of the safety cover altogether.

Figure 3:
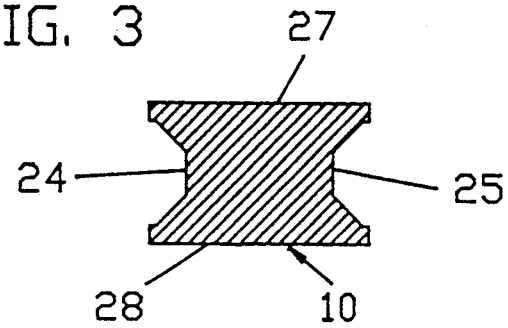
FIG. 3 shows a cross-sectional view of one portion of the electric extension cord receptacle shown in FIGS. 1 and 2.

In FIG. 3 there is shown a cross sectional view of the electric extension cord receptacle body 10, showing the recesses 24 and 25 in the vertical sides of the body 10 perpendicular to the socket surfaces 27 and 28. The shape and depth of the recesses 24 and 25 can be varied but must permit the insertion of the tips of the user's fingers into the recess and also provide significant purchase on the receptacle body 10 to permit easy withdrawal of electric plugs from the extension cord receptacle. Typically, the shape of each of the finger recesses 24 and 25 is that of a truncated pyramid or trapezium. As noted above, the depth of the recesses 24 and 25 are each at least fifteen percent of the width of the receptacle body, and no less than one quarter of an inch.

As can be clearly seen from FIG. 3, and as noted above, each finger recess 24 and 25 has a substantial purchase surface which is not parallel to the sides of the receptacle body 10, and which provides a significant purchase for holding the receptacle with the fingers. Each such purchase surface therefore has a projected area which faces at least partially in the same direction as the respective socket surface 27 or 28.

Figure 4:
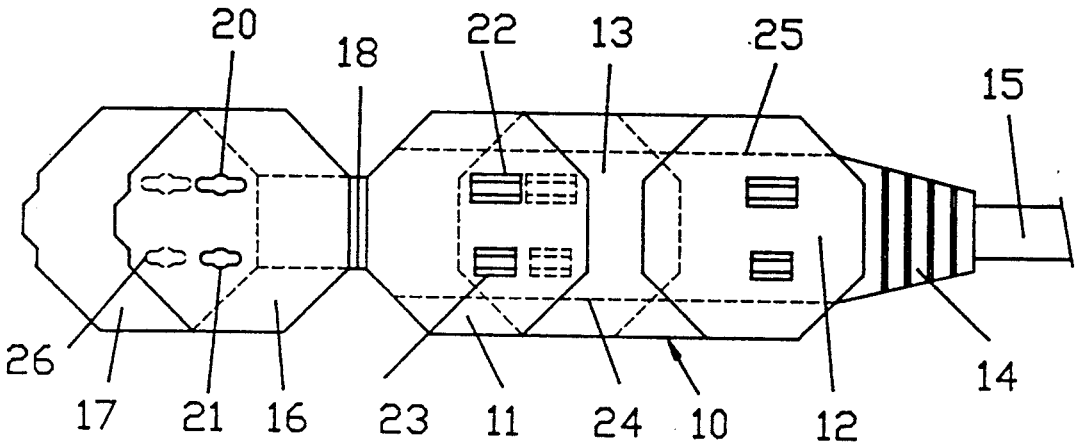
FIG. 4 shows a top plan view of the electric extension cord receptacle shown in FIGS. 1, 2 and 3.

In FIG. 4 there is shown a plan view of the electric extension cord receptacle shown in FIG. 1. Receptacle body 10 has electric sockets 11, 12 and 13 molded therein and safety cover flaps 16 and 17 molded onto one end of the body 10. A strain relief sleeve 14 connects electric cord 15 to the receptacle body 10 at the end opposite to the safety flaps 16 and 17.

Figure 5:
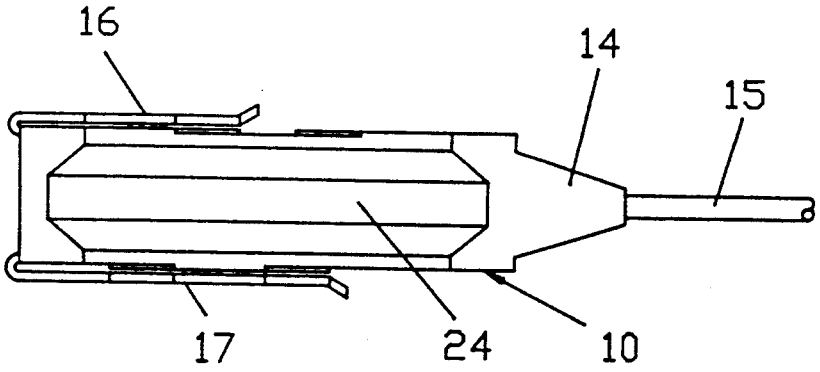
FIG. 5 shows a side elevation view of the electric extension cord receptacle shown in the other figures with the cover flaps covering openings in both sides of the electric extension cord receptacle.

In FIG. 5 there is shown a side view of the electric extension cord receptacle shown in FIG. 1 with the safety flaps 16 and 17 inserted into the socket slots of the adjacent electric sockets. A strain relief sleeve 14 connects electric cord 15 to the receptacle body 10. Recess 24 aids in the removal of the electric plugs from the receptacle by providing purchase for the user's fingers while holding the receptacle and removing such plugs.

It should also be clear to those skilled in the art that further embodiments of the present invention may be made by those skilled in the art without departing from the teachings of the present invention.

What is claimed is:

1. An electric extension cord receptacle comprising:

a generally box-shaped receptacle body with two opposing ends, two opposing sides and two opposing faces, said sides and faces being substantially longer than said ends, at least one electric socket on at least one of said two opposing faces, each said socket including at least two slots for receiving connector blades from mating electric plugs, said blades being removable from said slots by the exertion of a significant force parallel to said blades and slots, at least one pair of opposing finger recesses in said two longer opposing sides, said recesses being perpendicular to the direction of said force and having a substantial portion of their surface providing finger purchase to facilitate holding said receptacle while removing said electric plugs from said electric sockets, at least two non-conducting foldable flaps attached at one end of said flaps to one end of said receptacle body, a pair of plastic plugs molded into each of said foldable flaps for locking said flaps into said slots, and at least one line of reduced thickness material at said one end of each of said foldable flaps to form a preferred fold line for registering said plugs with said slots.

2. An electric extension cord receptacle comprising a generally box-shaped receptacle body with two opposing end, two opposing sides and two opposing faces, at least one electrical socket on each of said two opposing faces, each said socket including at least two slots for receiving connector blades from mating electrical plugs, at least two non-conducting foldable flaps attached at one end of said flaps to one end of said receptacle body at said two opposing faces, a pair of plastic plugs molded into each of said foldable flaps for locking said flaps into said slots, and at least one line of reduced thickness material at said one end of each of said foldable flaps to form a preferred fold line for registering said plugs with said slots.

3. The electric extension cord receptacle according to claim 2 further comprising a strain relief sleeve at one of said opposing ends of said receptacle body, and an electric cord for attachment to said receptacle body through said sleeve.

4. The electric extension cord receptacle according to claim 2 further comprising at least one pair of opposing finger recesses in said two opposing sides, said recesses being of a depth and contour to facilitate holding said receptacle while removing said electric plugs from said electric sockets.

5. The electric extension cord receptacle according to claim 4 wherein said finger recesses have a cross section corresponding to a truncated pyramid and having a depth at least fifteen percent of the width of said receptacle body between said opposing sides.

6. An electric extension cord receptacle comprising:

a receptacle body with two generally opposed ends, two generally opposed sides and two generally opposed faces, said receptacle having a longitudinal axis extending between said two ends;

at least one electric socket on at least one of said two generally opposed faces; and at least one finger recess in each of said two generally opposed sides, each of said at least one finger recess being of a depth and contour to facilitate holding said receptacle while removing an electrical plug from said at least one electrical socket;

each said finger recess having a first purchase surface wherein each said first purchase surface is suitable for receiving a person's fingers such that said receptacle can be held so as to generally counter the force generated by the removal of said electrical plug from said electric socket;

and wherein each said finger recess has a projected area which faces at least partially in the same direction as the face containing said at least one electric socket.

7. The electric extension cord receptacle of claim 6, having at least one electric socket on both of said two opposing faces;

and wherein each said at least one finger recess has a second purchase surface suitable for receiving a person's fingers, and each said second purchase surface has a projected area which faces at least partially in the opposite direction of each said first purchase surface.

8. The electric extension cord receptacle of claim 6, further comprising:

a strain relief sleeve at one of said opposing ends of said receptacle body; and an electric cord for attachment to said receptacle body through said sleeve.

9. The electric extension cord receptacle of claim 6, wherein each said first purchase surface of each said finger recess faces generally in the same direction as the face containing said at least one electric socket.

10. The electric extension cord receptacle of claim 9, wherein each said finger recess is generally elongated.

11. The electric extension cord receptacle of claim 10, wherein each said finger recess is oriented so as to be generally parallel to said longitudinal axis.

12. The electric extension cord receptacle of claim 11, wherein each said finger recess has a cross section having the shape of a trapezium.

13. The electric extension cord receptacle of claim 12, wherein each said finger recess has a depth of at least fifteen percent of the width of said receptacle body between said generally opposed sides thereof.

* * * * *